US005156294A

United States Patent [19]

Nichols

[11] Patent Number: 5,156,294

[45] Date of Patent: Oct. 20, 1992

[54] FOLDABLE BOX WITH INTERNAL BAG

[75] Inventor: Dwight E. Nichols, Beatrice, Nebr.

[73] Assignee: Hoover Group, Inc., Alpharetta, Ga.

[21] Appl. No.: 655,640

[22] Filed: Feb. 14, 1991

[51] Int. Cl.[5] ..... B65D 5/60; B65D 90/04

[52] U.S. Cl. ..... 220/403; 220/462; 220/441; 229/117.05; 229/117.06

[58] Field of Search ..... 220/403, 462, 441; 229/117.05, 117.06, 125.37

[56] References Cited

U.S. PATENT DOCUMENTS

| | | | |
|---|---|---|---|
| 2,019,787 | 11/1935 | Leopold | 229/117.05 |
| 2,852,206 | 9/1958 | Bolding | 229/117.06 |
| 2,961,140 | 11/1960 | Holmes | 220/462 |
| 3,204,849 | 9/1965 | Vinney | 220/441 |
| 4,094,458 | 6/1978 | Nelson, Jr. | 229/117.06 |
| 4,781,472 | 11/1988 | LaFleur et al. | 220/403 |
| 4,850,506 | 7/1989 | Heaps, Jr. et al. | 220/403 |
| 4,898,301 | 2/1990 | Schick | 220/441 |
| 5,048,691 | 9/1991 | Heuberger et al. | 220/403 |
| 5,074,460 | 12/1991 | Hanekamp | 229/117.05 |

FOREIGN PATENT DOCUMENTS

| | | | |
|---|---|---|---|
| 1022538 | 3/1966 | United Kingdom | 220/441 |

*Primary Examiner*—Stephen P. Garbe
*Assistant Examiner*—S. Castellano
*Attorney, Agent, or Firm*—Harness, Dickey & Pierce

[57] ABSTRACT

A container for liquids in the form of a foldable box with an internal flexible bag for containing the liquid. The box is formed in a manner which enables it to be expanded from a folded flat configuration to a three dimensional configuration. Two opposed sides of the box and the box end panels feature centrally positioned fold or crease lines. As the box is expanded from its folded flat to its three-dimensional configuration, open slots are formed at the ends which enable the bag to be inserted into the box. The bag is thereafter filled and the open slots at the box ends are sealed using tape or another fastening system. Following use, the box can be readily reused by cutting the fastening tape, refolding it flat and later refilled it with another bag.

9 Claims, 2 Drawing Sheets

FOLDABLE BOX WITH INTERNAL BAG

BACKGROUND AND SUMMARY OF THE INVENTION

This invention relates to a liquid container and particularly to such a container having an outer shell with an internal foldable bag filled with a liquid.

Many liquids used in industry and commercial activities are transported in and dispensed from box type containers having an internal story and dispensing pliable bag. For example, containers of this variety are used for syrups used for serving soft drinks at restaurants. These products are typically in the form of a cardboard box or shell made from folding and bonding a flat sheet of cardboard or plastic stock. A pliable plastic bag is placed in the box and thereafter filled with a liquid. The box opening provided to permit access to its interior is then sealed shut by bonding or mechanical fastener. Although such liquid containers have been in widespread use for some time there is a continuing desire to reduce the cost of such containers, and particularly, to optimize the manufacturing, fabrication and use of such containers. The present invention is related to an improved foldable box with an internal bag featuring enhancements in those areas.

The container in accordance with the present invention includes a foldable box which can be completely assembled and folded into a flat configuration, yet can be easily expanded to assume a three-dimensional configuration. The ends of the box feature open slots which enable an empty flexible bag to be inserted inside the box and thereafter filled. Fabrication is completed by taping or otherwise sealing the edge slots. Aside from the simple process of taping the box edges, there is no need for bonding end flaps of the box or using other types of mechanical fasteners. When the container is empty of liquids, the tape along the edges can be cut, allowing the internal bag to be removed and the box to be refolded. Both the box and bag can be reused or recycled, if desired.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
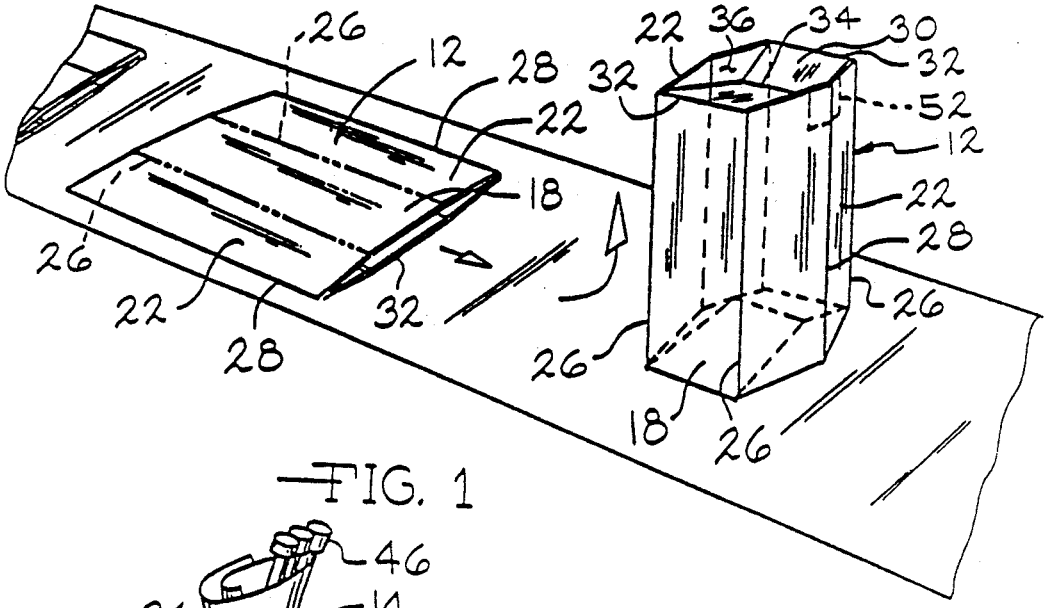
FIG. 1 is a pictorial view showing a foldable box of the container in accordance with this invention being transported down a conveyer and being expanded from a flat configuration to a three-dimensional configuration.

The container in accordance with the present invention is designated by reference number 10, and generally comprises a foldable box or shell 12 and a flexible liquid containing bag 14. The configuration of foldable box 12 is best explained with reference to FIG. 1. Box 12 can be made of cardboard or plastic and includes a pair of opposed sides 18 with another pair of sides 22 opposed to each other and joining sides 18 along corner edges 26. In the case of the embodiment illustrated in FIG. 1, sides 22 have a greater lateral width than sides 18. Sides 22 have a fold crease line 28 which is parallel to edges 26 and positioned midway along the lateral width of sides 22. Box 12 further includes ends 30 which join sides 18 along end edges 32, but are free from attachment to sides 22. Ends 30 have a fold crease line 34 parallel to edges 32 and positioned midway between those edges.

The foldable box 12 can be folded flat as shown in FIG. 1 by pushing sides 18 together and allowing sides 22 to bow outwardly by folding their halves together along fold creases 28. Simultaneously, ends 30 becomes folded flat by folding together along fold creases 34 and can either be folded into the box layers formed between adjacent sides 18 as shown in FIG. 1, or folded outwardly. Box 12 can be expanded to a three-dimensional configuration as shown in the upright position in FIG. 1, simply by pushing crease lines 28 together. As is shown in FIG. 1, as box 12 is expanded from its initial folded flat to its final three-dimensional configuration, a pair of open slot 36 are formed at both ends 30, between the ends and sides 22.

Bag 14 defines a closed internal volume and is from a flexible sheet material such as various forms of polymeric plastics. Dispensing tubes 46 communicate with the internal volume of bag 14 and are used for filling bag 14 with liquid and dispensing from the bag when the container is in use. The embodiment of container 10 shown in the drawings is well suited for dispensing soft drink syrups where the contents of the container would be dispensed through any or each of the three dispensing tubes 46.

Figure 2:
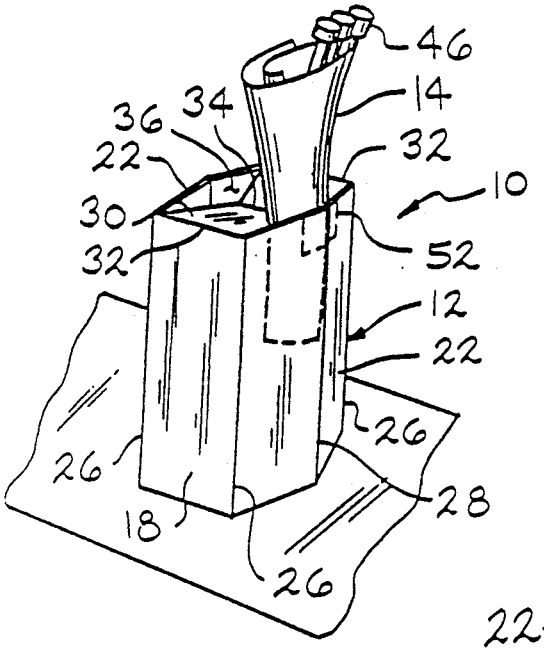
FIG. 2 is a pictorial view of the container according to this invention showing an empty flexible bag being inserted into the inside of the box.
Figure 3:
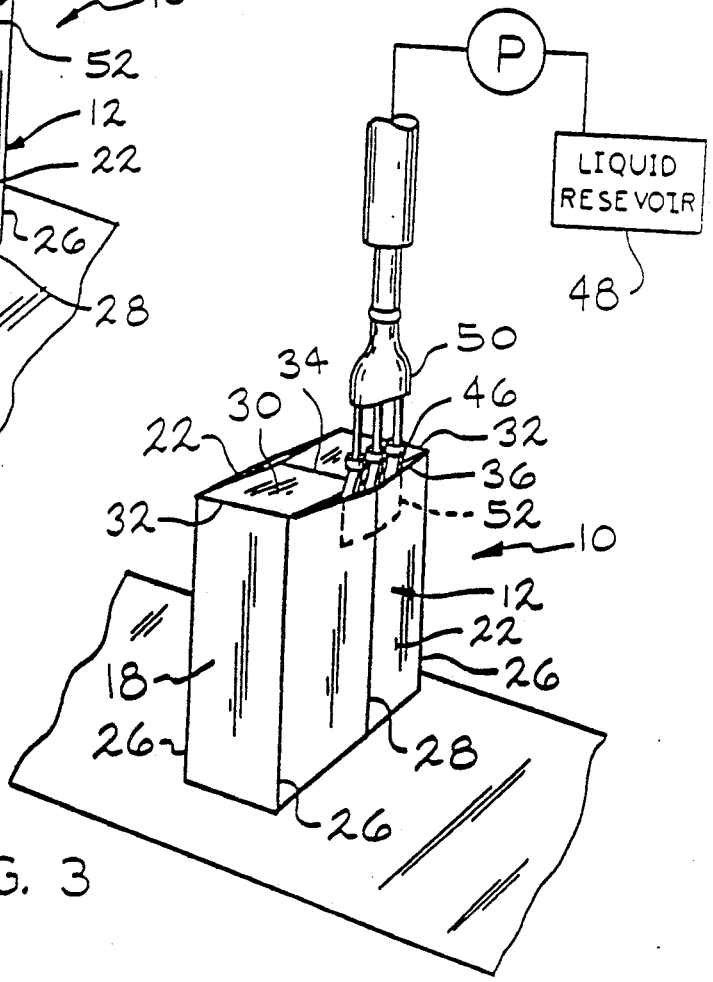
FIG. 3 is a pictorial view showing the internal bag of the container according to this invention being filled with a liquid.

The figures of this application disclose, in order, consecutive production and usage steps for container 10. In FIG. 1, box 12 is shown both in its normal folded flat storage condition and expanded to define an internal volume. In the case of FIG. 1 this expansion of box 12 is accompanied by placing it on one of its ends 30. FIG. 2 shows bag 14 being inserted into the internal volume of box 12 through one of the open slots 36. FIG. 3 illustrates bag 14 being filled from a liquid reservoir 48 through filler nozzle 50. Bag 14 is filled with a volume of liquid about equal to the internal volume of box 12 when it is fully expanded with ends 30 and sides 22 assuming a planar configuration. Box 12 may be provided with perforations or scoring 52 adjacent to the position of dispensing tubes 46 to provide convenient access to the tubes in the fully filled container 10.

Figure 4:
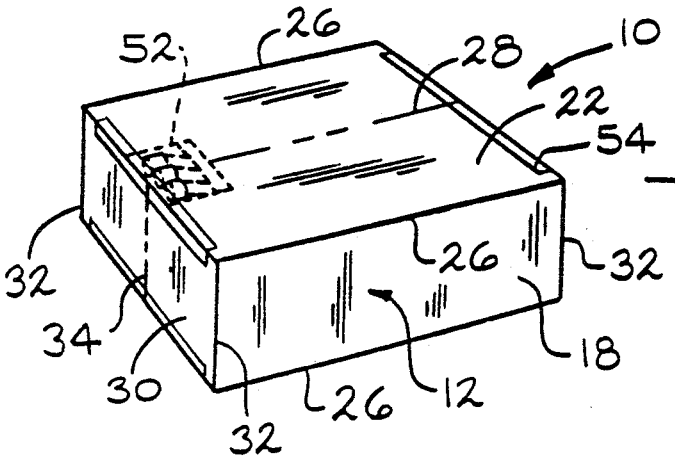
FIG. 4 is a pictorial view of the container according to this invention after the internal bag has been completely filled and the box edges sealed.
Figure 5:
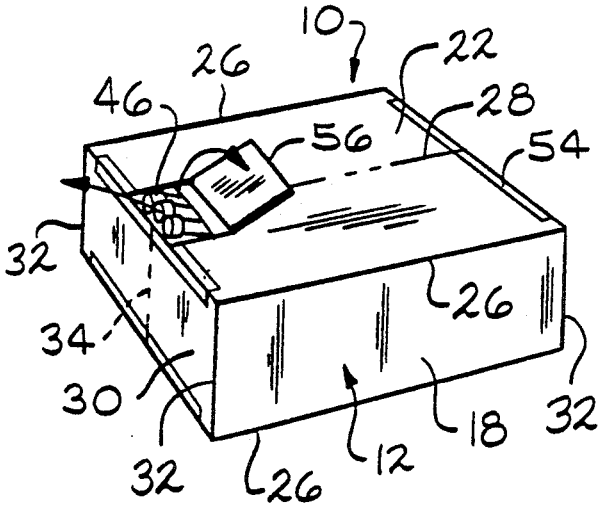
FIG. 5 is a pictorial view of the container according to this invention showing a dispensing door being opened in preparation for dispensing of the stored liquid.
Figure 6:
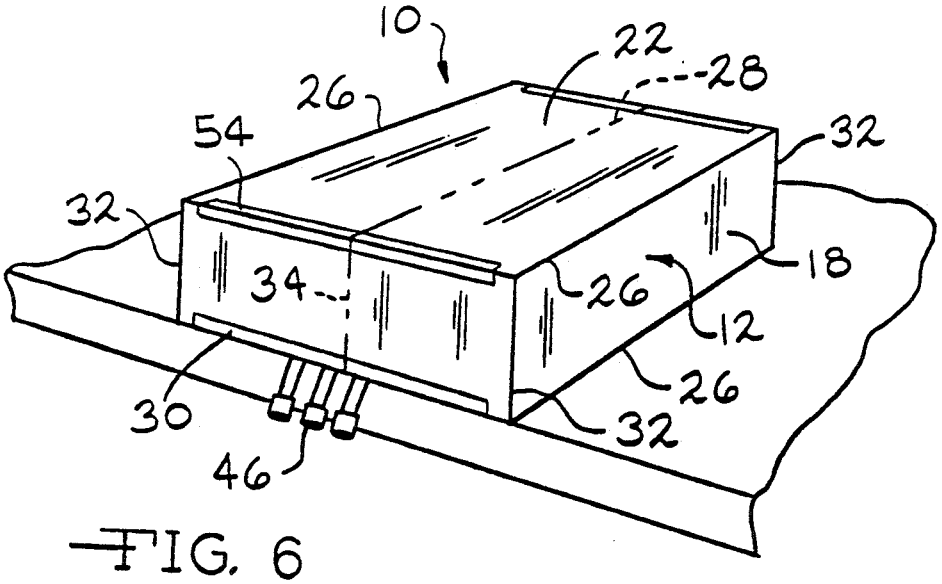
FIG. 6 shows the container according to this invention in position for the dispensing of the stored liquid.

After the filling step for container 10 is completed, slots 36 are preferably sealed closed with strips of tape 54 along the edges of ends 30 and sides 22. FIG. 4 shows container 10 in its completely filled condition ready for shipment, storage, or use, with tape strip 54 sealing open slots 36. FIG. 5 shows container 10 being prepared for use in dispensing a liquid by opening door 56 along score lines 52, exposing dispensing tubes 46. Container 10 can thereafter be inverted with the dispensing tubes 46 at the bottom surface of the container so as to provide gravity flow of liquid out of container 10.

Once container 10 has been emptied of its contents, both box 12 and bag 14 can be conveniently reused or recycled. The container is disassembled by removing or cutting tape strips 54 removing bag 14, and refolding the box to the configuration shown in FIG. 1. Box 14 is then ready for reuse without further modifications.

While the above description constitutes the preferred embodiments of the present invention, it will be appreciated that the invention is susceptible of modification, variation and change without departing from the proper scope and fair meaning of the accompanying claims.

I claim:

1. A container assembly for containing and dispensing a liquid comprising:

a box expandable from an initial folded flat configuration to a final three-dimensional configuration which defines an internal volume, said box defining an open slot along an end when said box is intermediate said folded flat and said three-dimensional configurations, said open slot closing upon said box being expanded into said three-dimensional configuration, and a pliable sealable bag having means for filling said bag with said liquid, said bag being foldable for insertion into said box through said open slot.

2. A container assembly according to claim 1 wherein said box defines a pair of opposed first sides with a pair of opposed second sides joining said first sides along corner edges wherein said first sides have the same height as said second sides measured along said corner edges, and said first sides having a greater width than said second sides and said first sides have a fold crease parallel to and midway between said corner edges whereby said box can be folded to said flat configuration by folding said second sides together causing said first sides to be folded onto themselves along said fold crease.

3. A container assembly according to claim 2 wherein said box includes first and second ends and further comprises a pair of end panels, one of said end panels joining said second sides at said first end and the other of said end panels joining said second sides at said second end, each of said end panels having a second fold crease parallel to and midway between the joining line between said end panels and said second side panels.

4. A container assembly according to claim 3 wherein said open slot is formed between said end panel and said first side.

5. A container assembly according to claim 4 further comprising at least one tape strip for sealing said open slot together by sealing between said end panel and said first side.

6. A container assembly according to claim 3 wherein when said box is in said flat configuration, each of said end panels are folded onto themselves along said second fold crease.

7. A container assembly for containing and dispensing a liquid comprising:

a box having a pair of opposed first sides joining a pair of opposed second sides along first corner edges, said first sides each having a first fold crease midway between and parallel to said first corner edges, said first sides and said second sides having first and second ends, said box further having a pair of end panels, one of said end panels extending between and joining said first ends of said second sides at second corner edges, the other of said end panels extending between and joining said ends of said second sides at another set of second corner edges, said end panels having a second fold crease midway between and parallel to said second fold creases, wherein said box is foldable to a folded flat configuration by forcing said second sides together and causing each of said first sides and each of said end panels to be folded onto themselves along said first and second fold creases respectively, said box expandable to a predetermined three-dimensional configuration by respectively forcing said first sides and said end panels to lie in a common plane, said box defining open slots between said first sides and said end panels when said box is intermediate said folded flat and said three-dimensional configurations, and a pliable sealable bag for containing a liquid having means for filling said bag with said liquid, said bag being foldable for insertion into said box through at least one of said open slots.

8. A container assembly according to claim 7 wherein said first sides have a lateral width greater than said second sides.

9. A container assembly according to claim 7 further comprising at least one tape strip for sealing said open slot together by sealing between said end panel and said first side.

* * * * *